US008789549B1

(12) United States Patent
Barnes

(10) Patent No.: US 8,789,549 B1
(45) Date of Patent: Jul. 29, 2014

(54) PORTABLE CANOPY ANCHORING DEVICE AND SYSTEM

(76) Inventor: William Rogers Barnes, Hemet, CA (US)

( * ) Notice: Subject to any disclaimer, the term of this patent is extended or adjusted under 35 U.S.C. 154(b) by 0 days.

(21) Appl. No.: 13/603,205

(22) Filed: Sep. 4, 2012

Related U.S. Application Data

(60) Provisional application No. 61/573,309, filed on Sep. 1, 2011.

(51) Int. Cl.
*E04H 15/62* (2006.01)

(52) U.S. Cl.
USPC ..... 135/118; 135/114; 135/116

(58) Field of Classification Search
USPC ..... 135/114, 116, 118; 248/346.2, 523, 529
See application file for complete search history.

(56) References Cited

U.S. PATENT DOCUMENTS 3,794,279 A * 2/1974 Kramer ..... 248/523
4,486,016 A * 12/1984 Rubin ..... 482/90
4,591,126 A * 5/1986 Berney ..... 248/524
5,020,764 A * 6/1991 Yamamoto ..... 248/529
5,169,111 A * 12/1992 Dunaj ..... 248/523
5,779,215 A * 7/1998 DeMasi ..... 248/523
6,080,089 A * 6/2000 Nicholson ..... 482/83
6,446,649 B1 * 9/2002 Bigford ..... 135/16
6,619,610 B1 * 9/2003 Genovese ..... 248/519
6,986,496 B2 * 1/2006 Roberts et al. ..... 248/519
7,878,478 B2 * 2/2011 Gumm ..... 248/529
8,424,549 B1 * 4/2013 Goldsmith et al. ..... 135/120.4
2009/0100789 A1 * 4/2009 Hornbeak et al. ..... 52/745.19

* cited by examiner

*Primary Examiner* — Noah Chandler Hawk
(74) *Attorney, Agent, or Firm* — Grant's Law Firm; Allan Grant

(57) ABSTRACT

A canopy anchoring system comprising a flexible anchoring sleeve of a cylindrical shape having a bore aperture positioned in the approximate center of the cylinder, the sleeve has a top portion and a bottom portion, the top portion of the sleeve contains a first top orifice for filling the sleeve with a liquid, the bottom portion of the sleeve contains a bottom orifice for draining the liquid from the sleeve, the top orifice and the bottom orifice each have a closure device, the sleeve with the bore aperture is constructed to allow a canopy leg to slide completely through, the canopy leg has a foot and a foot capturing puncture protection pad provides protection for the sleeve and securely capture the foot of the canopy leg.

4 Claims, 5 Drawing Sheets

PORTABLE CANOPY ANCHORING DEVICE AND SYSTEM

CROSS-REFERENCE TO RELATED APPLICATIONS

The present application claims priority under 35 U.S.C. 119(e) and under all applicable U.S. statutes and regulations, to U.S. Provisional Application Ser. No. 61/573,309, filed Sep. 1, 2011. The disclosure of which is hereby incorporated herein by reference in its entirety.

FIELD OF THE INVENTION

This invention relates in general to a portable canopy anchoring device and system.

BACKGROUND OF THE INVENTION

Canopies are utilized in many different applications. This includes tailgating on parking lots, setting up on boats, setting up in grandstands, setting up on various types of beaches and the like. Difficulties are presented with portable canopies when anchoring the canopies to the ground. Many canopies utilize a stake system used to anchor the canopy to the ground; however, oftentimes canopies need to be set up in areas such as parking lots where such an anchoring system is ineffective or damages the parking lot. Other methods of anchoring a canopy include utilizing bags of sand or similar material and placing them on or around the legs to hold the legs in place. While this helps hold a canopy in place on surfaces such as concrete these bags typically are very heavy, difficult to store and haul and take up much needed room in a vehicle.

Many boaters who frequent lakes and rivers face the problem of limited storage on their boats, while at the same time wanting to transport items to be used to set up a "day camp" on the shoreline. The "day camp" may be comprised of all sorts of portable, folding or collapsible items such as chairs, tables and canopies. The portable canopy, although light and collapsible, is also prone to lifting, overturn, and damage, even in light winds and/or sudden gusts. The uplifting or overturn of the unsecured canopy has the potential to cause injury to the users. This invention addresses the need of supplying sufficient weight to securely anchor the canopy legs so as to prevent the aforementioned hazards.

There are many existing inventions that deal with the anchoring of portable canopies. Although effective, they are not extremely "boat friendly". Some rely on collapsible bags that are to be filled with sand and either tethered or strapped to the canopy frame or leg. But, some shorelines do not have sandy beaches to get sand and upon collapsing these bags that were filled with sand for storage on the boat, much of the sand is retained, even after rinsing in the water, and thereby bringing sand into the boat. This invention seeks to overcome the problems associated with the other portable canopies.

Other existing inventions are of non-collapsible containers or vessels. They are typically fluent filled and secured using hardware or tethers. Their lack of being collapsed and easily stored makes them less than desirable for boating.

The last family of existing inventions utilize ground anchors or stakes. Unfortunately, in soft sand the anchors or stakes will get pulled out in windy conditions and in hard soils they are extremely hard to secure into the ground.

Lastly, with most of these canopy anchoring devices there is a tripping hazard and some are not easily stored.

This invention addresses the need of applying weight, and at the same time capturing the legs of a portable canopy for a secure anchoring in moderate winds and occasional gusts. This invention is specifically designed so that it can be easily folded or roll-up into very small profile requiring minimal storage space. This invention is also specifically designed to shed sand easily and rinse off almost completely sand-free. The additional benefits of this invention include: 1) no tripping hazard, i.e. on ropes, tethers, and stakes; 2) toe-stubbing protection; 3) ability to accept footed legs; and 4) suitable for all shoreline compositions.

Although the primary target of this invention is the boating population, it could easily be embraced by anyone with a portable collapsible canopy and a source of water. Recreational vehicle owners, home-owners, campers, vendors, etc. would be but a few.

Additionally, due to the shape of the portable canopy anchoring device, it yields itself well as a device upon which advertising and indicia can be positioned on and then attached to each leg of a vendor's canopy legs.

The basics of this invention is of a fluid filled cylindrical sleeve with a through bore aperture through which the canopy leg is placed. It is constructed from a flexible material that captures the canopy leg in the aperture when inflated with fluid, typically water. There is a fill orifice with a closure device on the top and a drain orifice with closure device near the bottom. In typical use, applications of this invention would be made to each canopy leg.

SUMMARY OF INVENTION

Accordingly, it is the primary object of this invention to provide improvements in anchors for canopies such as umbrellas or portable shelters.

It is an object of this invention to provide a anchoring device that captures and weights the leg(s) or pole(s) of a portable canopy.

It is an object of this invention to provide a device which addresses the need of applying weight, and at the same time capturing the legs of a portable canopy for a secure anchoring in moderate winds and occasional gusts.

It is an object of this invention to offer portable canopy users several advantages which are: (1) water filled and pressurized by air; (2) accepts poles (legs) of different sizes, shapes, and foot configurations; (3) compact when deflated for convenient storage; (4) sleeve anchors can be used effectively in the water; (5) are modular (stackable) if additional weight is required; (6) readily shed sand, dirt, ect. And are easily rinsed clean from mud, seaweed, algae, ect.; (7) does not require shovels, hammers, tethers, stakes, screw anchors, ect.; and (8) eliminates tripping hazard on ropes, injured toes or feet on ground stakes.

The basics of this invention is of a fluid filled cylindrical sleeve with a through bore aperture through which the canopy leg is placed. It is constructed from a flexible material that captures the canopy leg in the aperture when inflated with fluid, typically water. There is a fill orifice with a closure device on the top and a drain orifice with closure device near the bottom. In typical use, applications of this invention would be made fit around each canopy leg.

It is an object of this invention to provide a device that helps eliminate any accidental tripping on hazardous ropes, tethers, and/or stakes; yet provides a secure anchoring device.

It is also an object of this invention to provide a device that provides some toe-stubbing protection on each of the canopy legs.

It is a further object of this invention to provide a device that has the ability to accept footed legs.

What makes this invention unique is that it has the ability to accommodate canopy legs that are "footed" by actually capturing the leg when filled with water and pressurized with air. This is accomplished when the interior shaft's inside diameter decreases as it is pressurized.

It is a further object of this invention to utilizes a puncture protection pad that is designed to both capture the "foot" on the leg of the canopy and to provide protection to the anchoring sleeve from puncture.

It is an object of this invention to provide a device that allows for the secure placement of the device on various surfaces of different composition.

It is another object of the invention to provide an improved boat canopy anchor.

It is yet another object of the invention to provide an improved RV canopy anchor.

It is an object of this invention to provide a device that allows for the secure placement of the device on all beach shoreline compositions.

It is an object of this invention to provide a device that allows for the sleeve anchors to be used effectively in the water.

It is an object of the invention to provide a canopy anchor which can readily be installed and disassembled with a minimum of effort and experience.

It is another object of the invention to provide a canopy anchor which is conveniently and compactly stored when not in use. Additionally, this invention is specifically designed so that it can be easily folded or roll-up into very small profile requiring minimal storage space.

It is an object of this invention to provide a canopy anchor which is specifically designed to shed sand easily and allow the sand to be rinse off almost completely sand-free.

It is a further object of the invention to provide a canopy anchor which is relatively easy to manufacture, reliable in operation, and relatively inexpensive to produce.

It is an object of the invention to provide a Foot Capturing Puncture Protection Pad that is constructed from a semi-rigid material with a center hole to accept the canopy leg.

It is also an object of the invention to provide a Foot Capturing Puncture Protection Pad that is constructed with a radial slice that allows the pad to be placed on the foot of the canopy leg.

It is a further object of the invention to provide a Foot Capturing Puncture Protection Pad that is sufficiently thick to provide protection and securely capture the foot of the canopy leg.

These and further objects of the invention will become apparent to those skilled in the relevant art and after a study of the present disclosure of the invention.

In addition to the above objects, various other objects of this invention will be apparent from careful reading of this specification including the detail description contained herein below.

DETAILED DESCRIPTION OF THE INVENTION

These as well as other features of the present invention will become apparent upon reference to the accompanying drawings wherein like numerals designate corresponding parts in the several figures, summarized as follows.

Other features and advantages of the invention will become apparent from the following detailed description, taken in conjunction with the accompanying drawings, which illustrate, by way of example, various features of embodiments of the invention.

DETAILED DESCRIPTION

The following detailed description and accompanying drawings are provided for purpose of illustrating and describing presently preferred embodiments of the present invention and are not intended to limit the scope of the invention in anyway. It will be understood that various changes in the details, materials arrangements of parts or operational conditions which have been herein described and illustrated in order to explain the nature of the invention may be made by those skilled in the art within the principles and scope of this invention.

Figure 1:
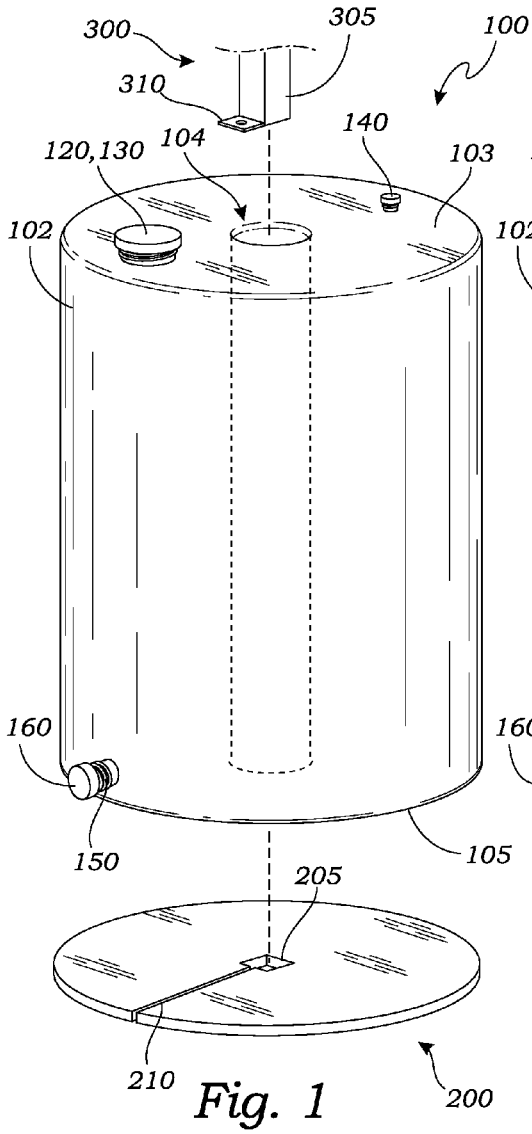
FIG. 1 is a perspective view of the invention showing an anchoring weighted sleeve, a footed canopy leg and a footed capturing puncture protection pad.
Figure 2:
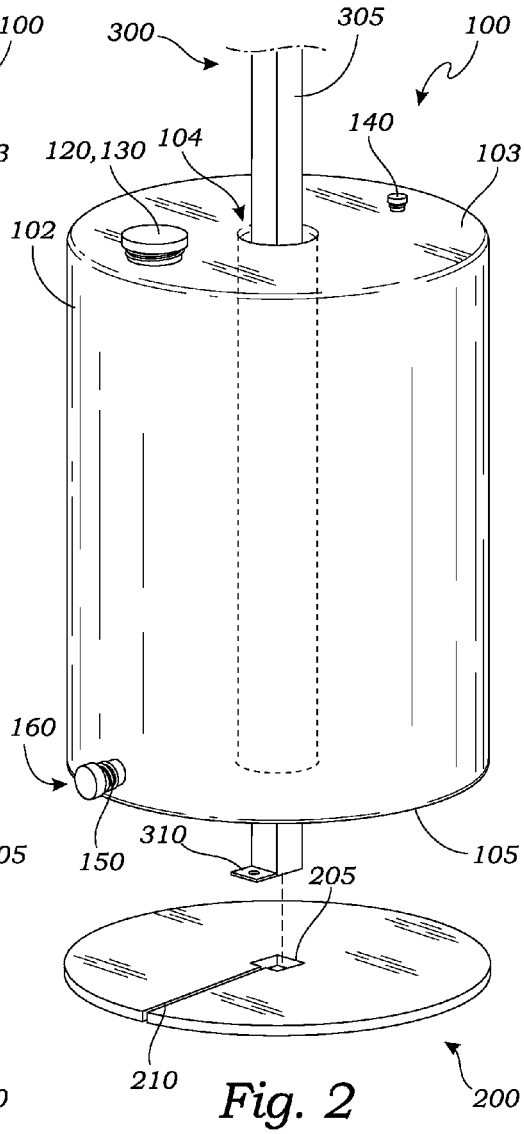
FIG. 2 is a perspective view of the invention showing the footed canopy leg inserted into the anchoring weighted sleeve and a footed capturing puncture protection pad.
Figure 3:
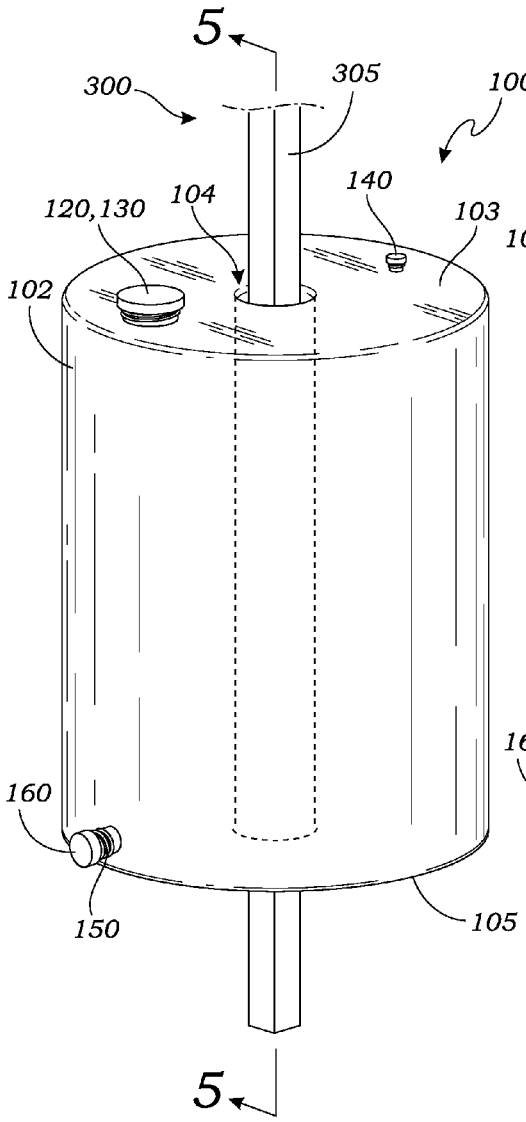
FIG. 3 is a perspective view of a canopy, wherein the invention is attached to one leg of the canopy, wherein said leg of the canopy does not have a foot and therefore a footed capturing puncture protection pad is not needed.
Figure 4:
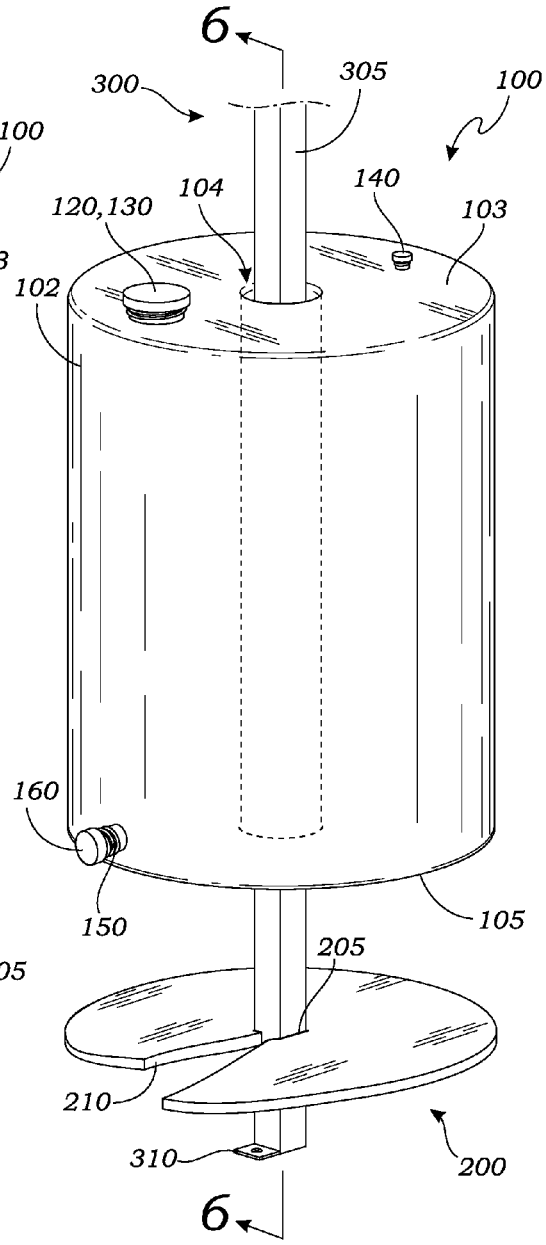
FIG. 4 is a perspective view of the invention showing the footed canopy leg inserted into the anchoring weighted sleeve and also inserted into a footed capturing puncture protection pad.
Figure 5:
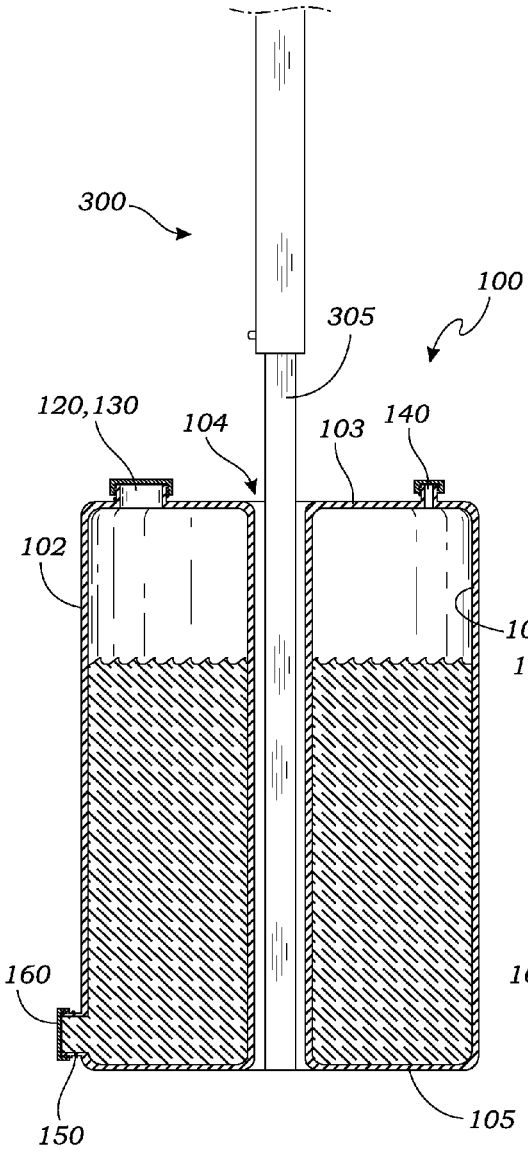
FIG. 5 is a side view of the invention showing a canopy leg inserted into the anchoring weighted sleeve, wherein the anchoring weighted sleeve is filled with a liquid substance such as water.
Figure 6:
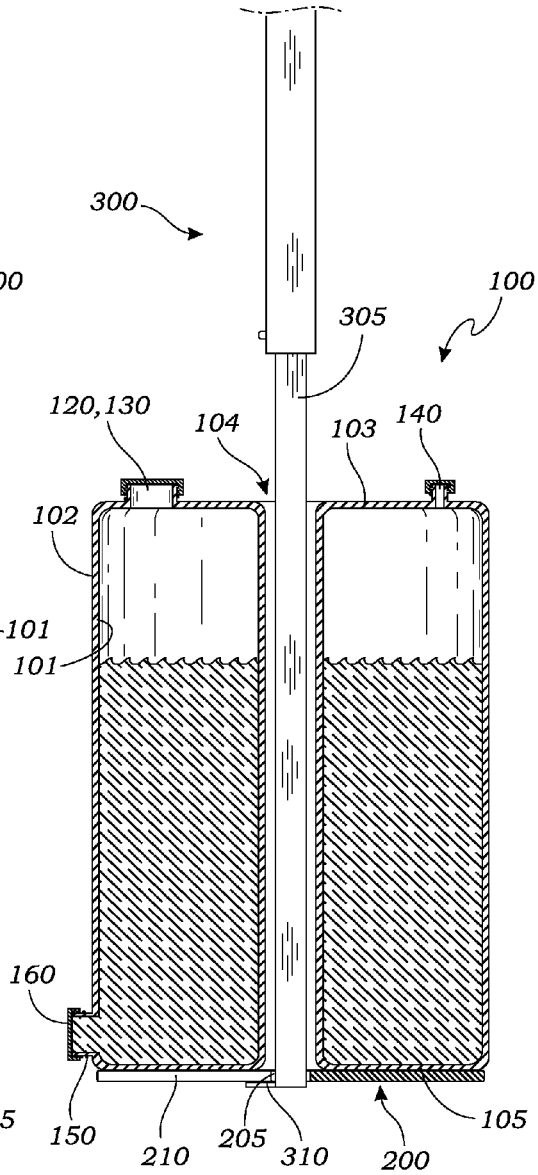
FIG. 6 is a side view of the invention showing the footed canopy leg inserted into the anchoring weighted sleeve and also inserted into a footed capturing puncture protection pad, wherein the anchoring weighted sleeve is filled with a liquid substance such as water.
Figure 7:
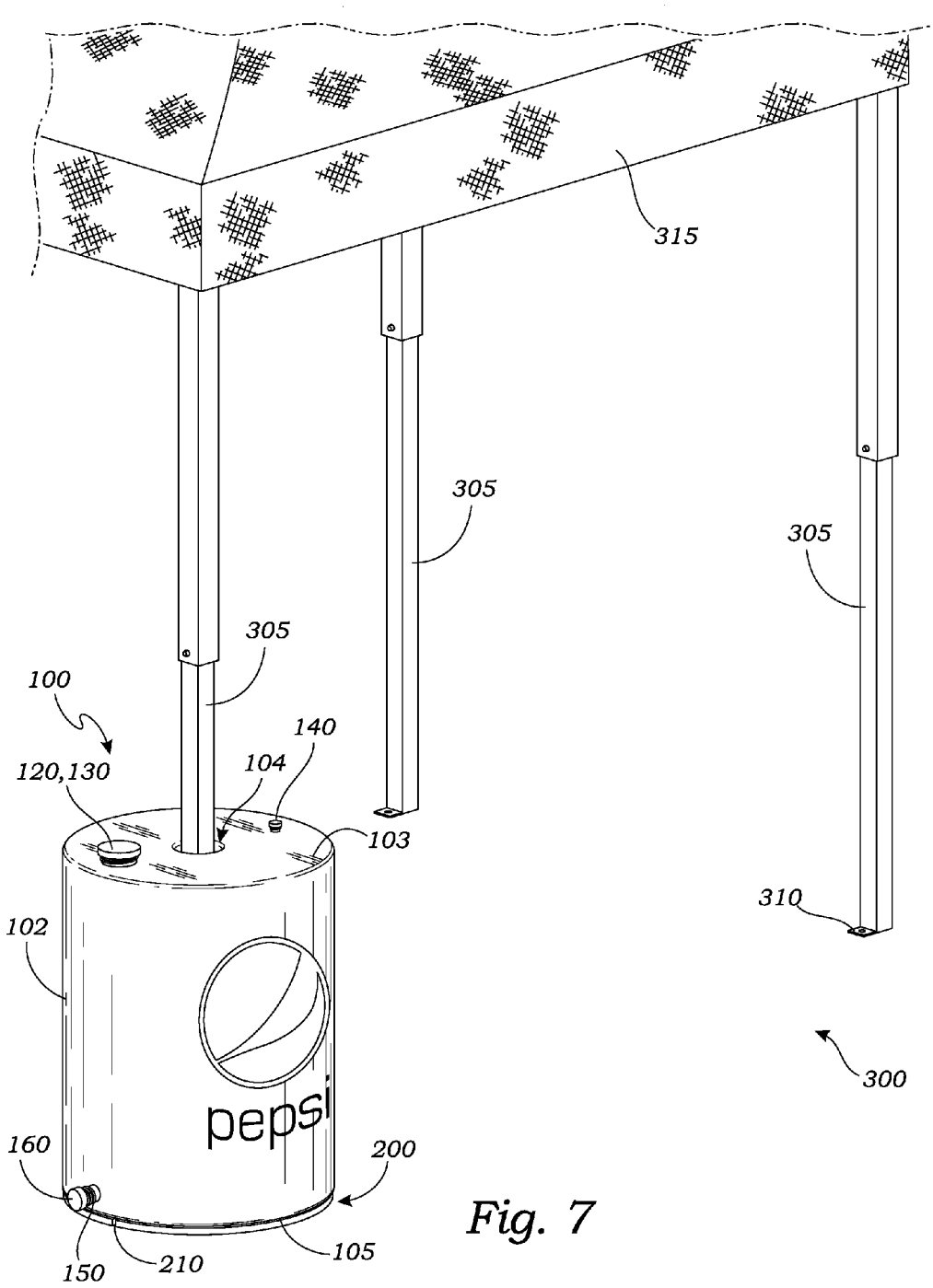
FIG. 7 is a perspective view of a canopy, wherein the invention is attached to one leg of the canopy, wherein said leg of the canopy has a foot.
Figure 9:
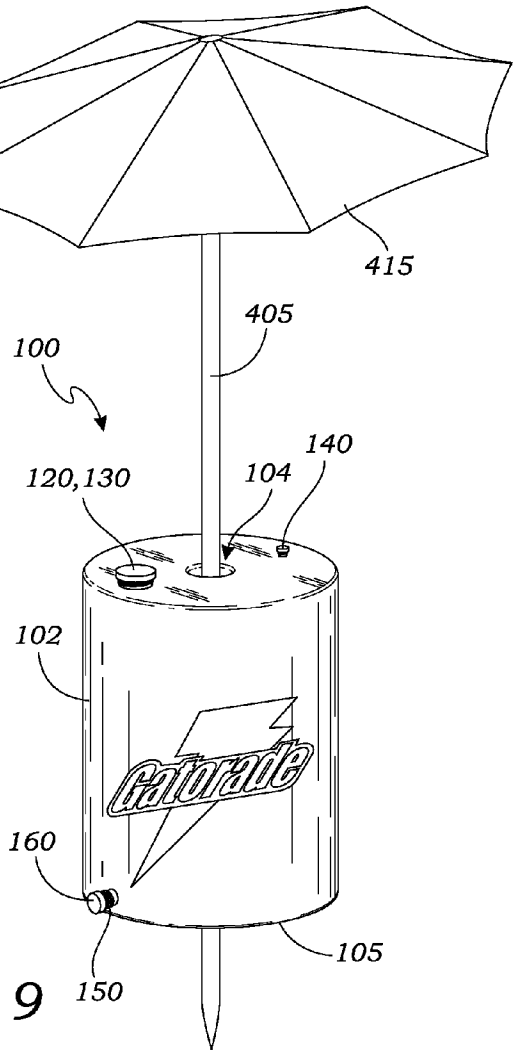
FIG. 9 is a perspective view of a canopy umbrella, wherein the invention is attached to the leg of the canopy.
Figure 8:
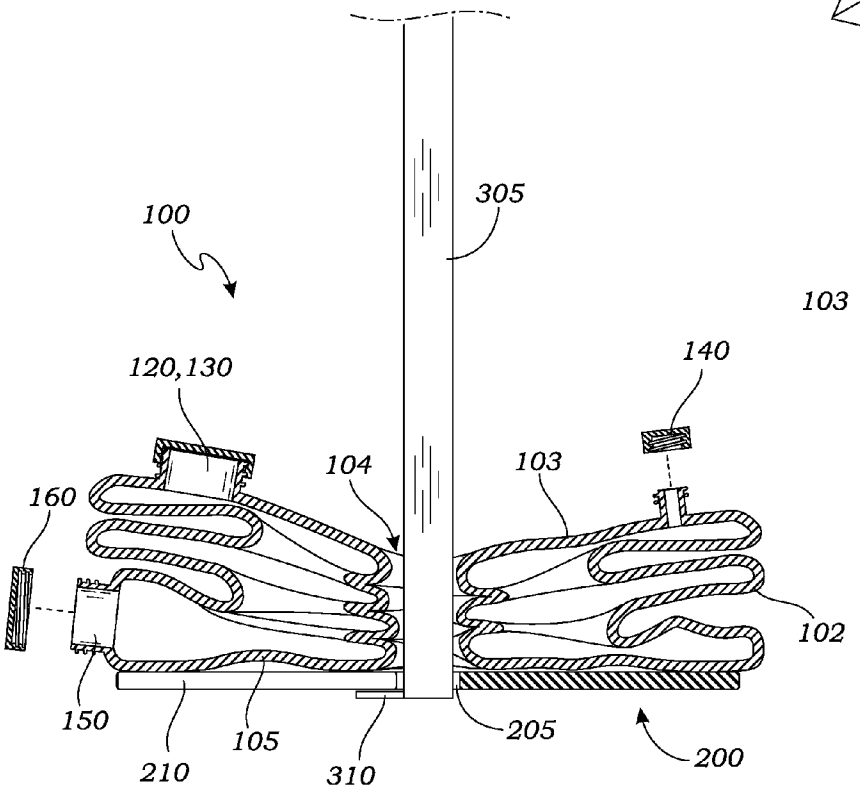
FIG. 8 is a side view of the invention showing the footed canopy leg inserted into the anchoring weighted sleeve and also inserted into a footed capturing puncture protection pad, wherein the anchoring weighted sleeve contains no air or liquid substance such as water.

Referring to the drawings more particularly by reference numbers, FIGS. 1 through 9 showing a Portable Canopy Anchoring Device and System designed to provide secure weighting or anchoring of portable "pop-up" style canopies 300 and provide stability in medium winds.

The invention in the preferred embodiment is comprised of a water filled air pressurized anchoring sleeve 100 and a foot capturing puncture protection pad 200.

The anchoring sleeve 100 is of a cylindrical shaped having a bore aperture 104 in the sleeve with a top portion 103 and bottom portion 105 of the sleeve 100 having mounted orifices complete with plugs or caps. The top orifice maybe a combination water fill/air inflation valve 120, or maybe two separate valves, one for water filling orifice 130 and one for air inflation/pressurization orifice 140. Top fill valves will have a flap to minimize pressure loss when inflating/pressurizing. The bottom portion 105 of the sleeve has a drain orifice 150. Each of the orifices has a closure device 160 such as a plug.

In an alternative embodiment not shown, the top orifice(s) can be positioned on the side wall instead on top of the sleeve to allow for easier access, if necessary.

The invention utilizes a foot capturing puncture protection pad 200 that is constructed from a semi-rigid material with a center hole 205 to accept the canopy leg 305. The foot capturing puncture protection pad that is constructed with a radial slice 210 that allows the pad to be placed on the foot of the canopy leg. The foot capturing puncture protection pad is sufficiently thick and wide enough to provide protection for the sleeve and securely capture the foot of the canopy leg. The foot capturing puncture protection pad also provides weight distribution.

The invention is used by sliding the anchoring sleeve 100 onto the distal end or footed end 310 of a canopy leg 305 ensuring the water/air fill orifice is on top. It is slide on until it completely clear the foot 310 of the canopy leg 305. Next the pad if opened by separating the radial slice and placed it on top of the foot ensuring that the radial slice is not over the foot. The bottom of the sleeve is positioned on the top of the pad, then filled with water through the top orifice until it accepts no more liquid (water) or the desired amount of weight is achieved. The sleeve will now be pressurized by air inflation until the sleeve becomes rigid and the inner shaft securely captures the leg. This process is repeated on all of the canopy legs.

If a pressurized source of water is available i.e. from a garden hose and hose bib, manual air inflation/pressurization will not be required.

The invention in one embodiment is further comprised of a sleeve type cylinder tube that has a through-bore aperture in the approximate center of the cylinder. Wherein the top portion of the sleeve contains a combination filling orifice for air and liquid and closure device, i.e. cap or plug. There is a bottom face that is unremarkable. There is an interior wall forming the through-bore aperture which is unremarkable. There is an exterior wall which includes a draining orifice with a closure device, i.e. cap or plug.

The invention in an alternative embodiment is further comprised of a sleeve type cylinder tube that has a through-bore aperture in the approximate center of the cylinder. Wherein the top portion of the sleeve contains both water and air filling orifices and a closure device for each orifice, i.e. cap or plug. There is a bottom face that is unremarkable. There is an interior wall forming the through-bore aperture which is unremarkable. There is an exterior wall which includes a draining orifice with a closure device, i.e. cap or plug.

The invention is for a fluid filled (typically water), portable, knock down (by volume reduction), anchoring device that captures and weights the leg(s), or pole(s) of a portable canopy or portable shelter.

What makes this invention unique is that it has the ability to accommodate canopy legs that are "footed" by actually capturing the leg when filled with water and pressurized with air. This is accomplished when the interior shaft's inside diameter decreases as it is pressurized. The other part of the system utilizes a puncture protection pad that is designed to both capture the "foot" on the leg of the canopy and to provide protection to the anchoring sleeve from puncture.

Another advantage, especially for boaters and recreational vehicle users is that the anchor sleeve collapses down to an extremely small profile by volume reduction. This allows for convenient storage when storage space is at a premium.

This invention also sheds sand and mud making for a cleaner boat, or RV.

Lastly, the invention eliminates the hazards of tripping, stubbed toes, and lacerations from ground stakes.

This invention may be used instead of relying upon: sand filled buckets or bags, ground stakes and tethers, large non-collapsible weights, or even searching for rocks and logs to tether too.

Although the focus of this invention is for boaters, it may be adapted to many different uses. It may be used anywhere there is access to water, and may be applied to any vertical, or near vertical staff of the right size.

Construction of the Invention. The invention is constructed from flexible, UV resistant material such as, but not limited to flexible polyvinyl plastics. The preferred fabrication is accomplished by, but not limited to RF welding or heat seaming.

Using the Invention. To apply the invention, the deflated invention is slipped over the distal portion of the canopy leg (with the fill orifice on the top) through the through-bore aperture, and pulled up high enough to clear the canopy leg foot (if so equipped). Ensuring the bottom drain orifice is securely closed, the top fill orifice is opened. A filling hose is inserted into the fill orifice and water added. As the invention is filled it will self-erect. As pressure inside the invention increases the aperture of the through-bore will decrease, in essence securely capturing the canopy leg. When the desired pressure is obtained the filling hose is removed and the filling orifice closed. Preferred practice would dictate a plurality of applications of the invention on all canopy legs.

To remove the invention the bottom drain orifice closure device is opened or removed. Although head pressure will remove the majority of water, the filling orifice may be opened to provide venting. Once the invention reaches a flaccid state the invention may be slipped over the canopy leg foot (if so equipped) and removed from the canopy leg.

To prepare the invention for storage it may first be rinsed free off sand or other matter. One or both orifices may be opened, however the preferred method is to close the filling orifice and opening the drain orifice. The invention is laid flat on a surface and rolled lengthways starting from the top face end and expelling any additional trapped water or air through the drain orifice. The drain orifice should then be closed. Once rolled the invention may be secured by bands, straps or other means to maintain compactness for storage.

While the description above refers to particular embodiments of the present invention, it will be understood that many modifications may be made without departing from the spirit thereof. The presently disclosed embodiments are therefore to be considered in all respects as illustrative and not restrictive.

The invention claimed is:

1. A canopy anchoring system comprising:

a flexible anchoring sleeve of a cylindrical shape having a bore aperture positioned in the approximate center of the cylinder;

said sleeve has a top portion and a bottom portion;

said top portion of the sleeve contains a first top orifice for filling said sleeve with a liquid;

said bottom portion of the sleeve contains a bottom orifice for draining said liquid from said sleeve;

said first and second orifices each have a closure device;

said sleeve with said bore aperture is constructed to allow a canopy leg to slide completely through;

wherein the anchoring sleeve is filled with liquid through the top orifice until the desired amount of weight is achieved;

wherein said anchoring sleeve will now be pressurized by air inflation until the sleeve becomes rigid and the inner shaft securely captures the leg;

wherein said leg of said canopy has a foot and said invention further comprises a foot capturing puncture protection pad that is used to secure said foot of said leg to prevent any puncturing of the sleeve from said foot;

said foot capturing puncture protection pad is constructed from a semi-rigid material with a center hole to accept said canopy leg; and said foot capturing puncture protection pad is constructed with a radial slice that allows the pad to be placed on the foot of the canopy leg.

2. The canopy anchoring system of claim 1, further comprising said foot capturing puncture protection pad provides protection for the sleeve and securely capture the foot of the canopy leg.

3. A canopy anchoring system comprising:

a flexible anchoring sleeve of a cylindrical shape having a bore aperture positioned in the approximate center of the cylinder;

said sleeve has a top portion and a bottom portion;

said top portion of the sleeve contains a first top orifice for filling said sleeve with a liquid;

said bottom portion of the sleeve contains a bottom orifice for draining said liquid from said sleeve;

said top orifice and said bottom orifice each have a closure device;

said sleeve with said bore aperture is constructed to allow a canopy leg to slide completely through;

said canopy leg has a foot;

a foot capturing puncture protection pad provides protection for said sleeve and securely capture said foot of said canopy leg;

wherein the anchoring sleeve is filled with liquid through the top orifice. until the desired amount of weight is achieved;

wherein said anchoring sleeve will now be pressurized by air inflation until the sleeve becomes rigid and the inner shaft securely captures the leg; and said foot capturing puncture protection pad with a radial slice that quickly and easily allows said pad to be placed on the foot of said canopy leg.

4. A canopy anchoring system comprising:

a flexible anchoring sleeve of a cylindrical shape having a bore aperture positioned in the approximate center of the cylinder;

said sleeve is collapsible down to an extremely small profile by volume reduction to allow for easy storage when no liquid is contained in said sleeve;

said sleeve has a top portion and a bottom portion;

said top portion of the sleeve contains a first top orifice for filling said sleeve with a liquid;

said bottom portion of the sleeve contains a bottom orifice for draining said liquid from said sleeve;

said top orifice and said bottom orifices each have a closure device;

wherein the anchoring sleeve is slid onto a canopy leg until the bottom of the canopy leg has completely passed through;

wherein the anchoring sleeve is filled with liquid through the top orifice until the desired amount of weight is achieved;

wherein said anchoring sleeve will now be pressurized by air inflation until the sleeve becomes rigid and the inner shaft securely captures the leg;

wherein said top portion of the sleeve contains a second top orifice that is separate for filling said sleeve with air and an additional closure device for said orifice;

said leg of said canopy has a foot and said invention further comprises a foot capturing puncture protection pad that is used to secure said foot of said leg to prevent any puncturing of the sleeve from the foot; and said foot capturing puncture protection pad is constructed with a radial slice that allows the pad to be placed on the foot of said canopy leg.

* * * * *